US007968503B2

(12) United States Patent
Yadav

(10) Patent No.: US 7,968,503 B2
(45) Date of Patent: Jun. 28, 2011

(54) MOLYBDENUM COMPRISING NANOMATERIALS AND RELATED NANOTECHNOLOGY

(75) Inventor: Tapesh Yadav, Longmont, CO (US)

(73) Assignee: PPG Industries Ohio, Inc., Cleveland, OH (US)

( * ) Notice: Subject to any disclaimer, the term of this patent is extended or adjusted under 35 U.S.C. 154(b) by 1133 days.

(21) Appl. No.: 11/146,083

(22) Filed: Jun. 7, 2005

(65) Prior Publication Data

US 2006/0079410 A1 Apr. 13, 2006

Related U.S. Application Data

(60) Provisional application No. 60/577,539, filed on Jun. 7, 2004.

(51) Int. Cl.
*C01G 39/06* (2006.01)
*C09C 1/00* (2006.01)

(52) U.S. Cl. ..... 508/167; 508/169; 106/439

(58) Field of Classification Search ..... 508/167, 508/169; 106/439
See application file for complete search history.

(56) References Cited

U.S. PATENT DOCUMENTS

| | | | | |
|---|---|---|---|---|
| 5,523,006 | A * | 6/1996 | Strumban | 508/150 |
| 5,549,836 | A * | 8/1996 | Moses | 508/183 |
| 5,788,738 | A | 8/1998 | Pirzada et al. | |
| 5,851,507 | A | 12/1998 | Pirzada et al. | |
| 5,984,997 | A | 11/1999 | Bickmore et al. | |
| 6,228,904 | B1 | 5/2001 | Yadav et al. | |
| 6,312,812 | B1 * | 11/2001 | Hauser et al. | 428/412 |
| 6,344,271 | B1 | 2/2002 | Yadav | |
| 6,569,397 | B1 | 5/2003 | Yadav | |
| 6,652,967 | B2 | 11/2003 | Yadav | |
| 6,719,821 | B2 | 4/2004 | Yadav | |
| 6,832,735 | B2 | 12/2004 | Yadav | |
| 6,878,676 | B1 * | 4/2005 | Migdal et al. | 508/230 |
| 2003/0132420 | A1 | 7/2003 | Yadav | |

FOREIGN PATENT DOCUMENTS

WO WO 01/94504 * 12/2001

* cited by examiner

*Primary Examiner* — Walter D Griffin
*Assistant Examiner* — Frank C Campanell

(57) ABSTRACT

Nanoparticles comprising molybdenum, methods of manufacturing nanoparticles comprising molybdenum, and nanotechnology applications of nanoparticles comprising molybdenum, such as electronics, optical devices, photonics, reagents for fine chemical synthesis, pigments and catalysts, are provided.

20 Claims, 1 Drawing Sheet

MOLYBDENUM COMPRISING NANOMATERIALS AND RELATED NANOTECHNOLOGY

CROSS-REFERENCE TO RELATED PATENT APPLICATIONS

The present application claims benefit of provisional application No. 60/577,539 filed Jun. 7, 2004, which application is hereby incorporated by reference in its entirety.

FIELD OF THE INVENTION

The present invention relates to methods of manufacturing submicron and nanoscale powders comprising molybdenum and applications of such powders.

INTRODUCTION

Nanopowders in particular and sub-micron powders in general are a novel family of materials whose distinguishing feature is that their domain size is so small that size confinement effects become a significant determinant of the materials' performance. Such confinement effects can, therefore, lead to a wide range of commercially important properties. Nanopowders, therefore, are an extraordinary opportunity for design, development and commercialization of a wide range of devices and products for various applications. Furthermore, since they represent a whole new family of material precursors where conventional coarse-grain physiochemical mechanisms are not applicable, these materials offer unique combinations of properties that can provide components of unmatched performance. Yadav et al. in U.S. Pat. No. 6,344,271 and in co-pending and commonly assigned U.S. patent application Ser. Nos. 09/638,977, 10/004,387, 10/071,027, 10/113,315, and 10/292,263, all of which along with the references contained therein are hereby incorporated by reference in their entirety, teach some applications of sub-micron and nanoscale powders.

SUMMARY OF THE INVENTION

Briefly stated, the present invention provides methods for manufacturing nanoscale powders comprising molybdenum and applications thereof.

In some embodiments, the present invention provides nanoparticles comprising doped or undoped molybdenum compounds.

In some embodiments, the present invention provides methods for manufacturing doped or undoped metal oxides comprising molybdenum.

In some embodiments, the present invention provides composites and coatings comprising doped or undoped molybdenum.

In some embodiments, the present invention provides applications of powders comprising doped or undoped molybdenum.

In some embodiments, the present invention provides ultraviolet absorbing pigment that can be used in a variety of applications.

In some embodiments, the present invention provides catalysts for a variety of applications.

In some embodiments, the present invention provides additives for a variety of applications.

In some embodiments, the present invention provides materials and devices for optical, sensing, thermal, biomedical, structural, superconductive, energy, security and other uses.

In some embodiments, the present invention provides methods for producing novel nanoscale powders comprising molybdenum in high volume, low-cost, and reproducible quality.

DETAILED DESCRIPTION OF THE INVENTION

Figure 1:
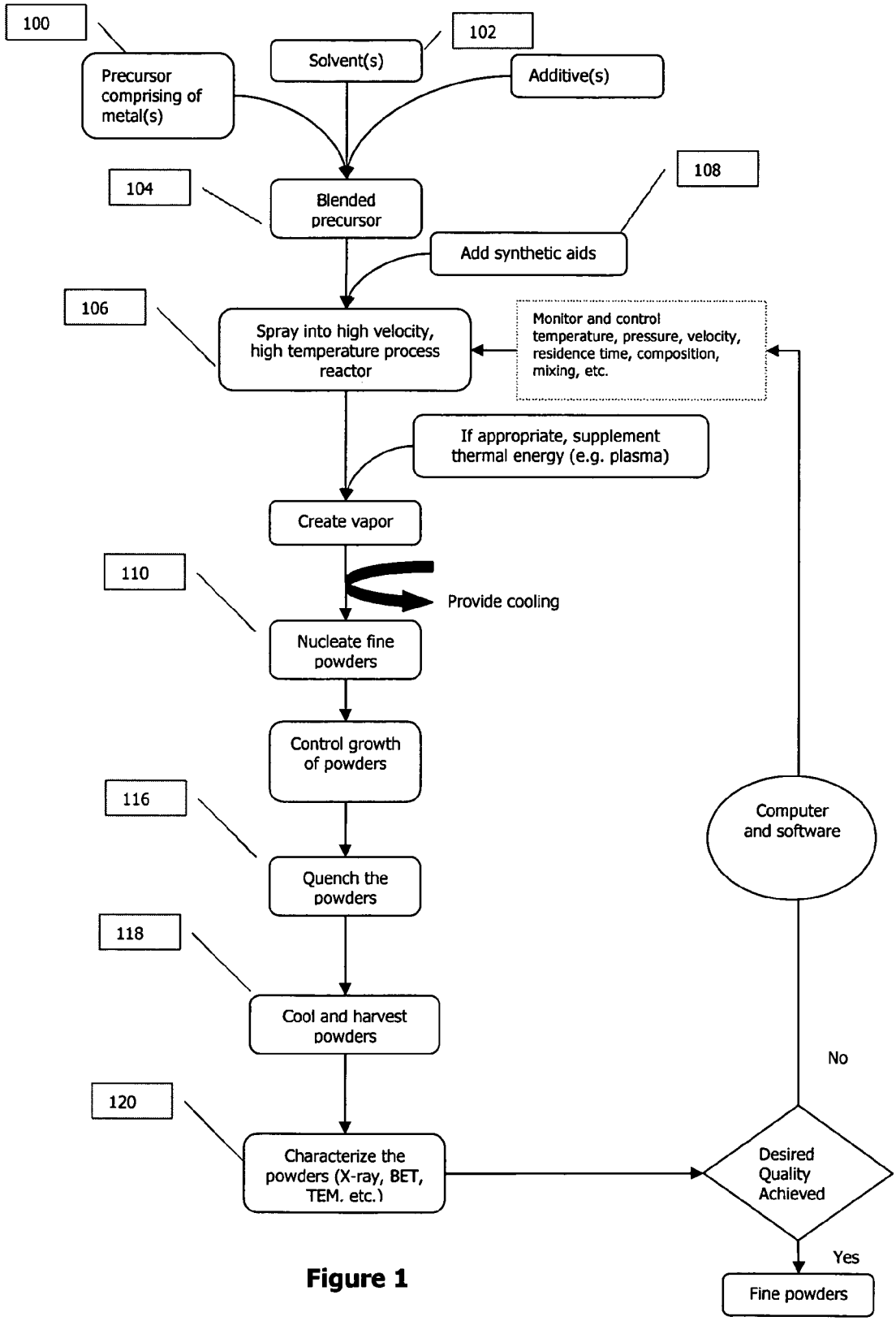
FIG. 1 shows an exemplary overall approach for producing submicron and nanoscale powders in accordance with the present invention.

This invention is generally directed to very fine powders comprising molybdenum (Mo). The invention includes high purity powders. Powders discussed herein are of mean crystallite size less than 1 micron, and in certain embodiments less than 100 nanometers. Methods for producing and utilizing such powders in high volume, low-cost, and reproducible quality are also outlined.

DEFINITIONS

For purposes of clarity the following definitions are provided to aid the understanding of the description and specific examples provided herein. Whenever a range of values are provided for a specific variable, both the upper and lower limit of the range are included within the definition.

"Fine powders," as the term is used herein, refers to powders that simultaneously satisfy the following criteria:

(1) particles with mean size less than 10 microns; and (2) particles with aspect ratio between 1 and 1,000,000.

For example, in some embodiments, the fine powders are powders that have particles with a mean domain size less than 5 microns and with an aspect ratio ranging from 1 to 1,000,000.

"Submicron powders," as the term is used herein, refers to fine powders with a mean size less than 1 micron. For example, in some embodiments, the submicron powders are powders that have particles with a mean domain size less than 500 nanometers and with an aspect ratio ranging from 1 to 1,000,000.

The terms "nanopowders," "nanosize powders," "nanoparticles," and "nanoscale powders" are used interchangeably and refer to fine powders that have a mean size less than 250 nanometers. For example, in some embodiments, the nanopowders are powders that have particles with a mean domain size less than 100 nanometers and with an aspect ratio ranging from 1 to 1,000,000.

Pure powders, as the term is used herein, are powders that have composition purity of at least 99.9% by metal basis. For example, in some embodiments the purity is 99.99%.

Nanomaterials, as the term is used herein, are materials in any dimensional form and domain size less than 100 nanometers.

"Domain size," as that term is used herein, refers to the minimum dimension of a particular material morphology. In the case of powders, the domain size is the grain size. In the case of whiskers and fibers, the domain size is the diameter. In the case of plates and films, the domain size is the thickness.

The terms "powder," "particle," and "grain" are used interchangeably and encompass oxides, carbides, nitrides, borides, chalcogenides, halides, metals, intermetallics, ceramics, polymers, alloys, and combinations thereof. These terms include single metal, multi-metal, and complex compositions. These terms further include hollow, dense, porous, semi-porous, coated, uncoated, layered, laminated, simple, complex, dendritic, inorganic, organic, elemental, non-elemental, composite, doped, undoped, spherical, non-spherical, surface functionalized, surface non-functionalized, stoichiometric, and non-stoichiometric forms or substances. Further, the term "powder" in its generic sense includes one-dimensional materials (fibers, tubes, etc.), two-dimensional materials (platelets, films, laminates, planar, etc.), and three-dimensional materials (spheres, cones, ovals, cylindrical, cubes, monoclinic, parallelolipids, dumbbells, hexagonal, truncated dodecahedron, irregular shaped structures, etc.).

"Aspect ratio," as the term is used herein, refers to the ratio of the maximum to the minimum dimension of a particle.

"Precursor," as the term is used herein, encompasses any raw substance that can be transformed into a powder of same or different composition. In certain embodiments, the precursor is a liquid. The term precursor includes, but is not limited to, organometallics, organics, inorganics, solutions, dispersions, melts, sols, gels, emulsions, or mixtures.

"Powder," as the term is used herein, encompasses oxides, carbides, nitrides, chalcogenides, metals, alloys, and combinations thereof. The term includes hollow, dense, porous, semi-porous, coated, uncoated, layered, laminated, simple, complex, dendritic, inorganic, organic, elemental, non-elemental, dispersed, composite, doped, undoped, spherical, non-spherical, surface functionalized, surface non-functionalized, stoichiometric, and non-stoichiometric forms or substances.

"Coating" (or "film" or "laminate" or "layer"), as the term is used herein, encompasses any deposition comprising submicron and nanoscale powders. The term includes in its scope a substrate, surface, deposition, or a combination thereof that is hollow, dense, porous, semi-porous, coated, uncoated, simple, complex, dendritic, inorganic, organic, composite, doped, undoped, uniform, non-uniform, surface functionalized, surface non-functionalized, thin, thick, pretreated, post-treated, stoichiometric, or non-stoichiometric form or morphology.

"Dispersion," as the term is used herein, encompasses inks, pastes, creams, lotions, Newtonian, non-Newtonian, uniform, non-uniform, transparent, translucent, opaque, white, black, colored, emulsified, with additives, without additives, water-based, polar solvent-based, or non-polar solvent-based mixture of powder in any fluid or fluid-like state of substance.

This invention is directed to submicron and nanoscale powders comprising doped or undoped molybdenum oxides in certain embodiments. Given the relative abundance of molybdenum in the earth's crust and current limitations on purification technologies, it is expected that many commercially produced materials would have naturally occurring molybdenum impurities. These impurities are expected to be below 100 parts per million and in most cases in concentration similar to other elemental impurities. Removal of such impurities does not materially affect the properties of interest to an application. For the purposes herein, powders comprising molybdenum impurities wherein molybdenum is present in a concentration similar to other elemental impurities are excluded from the scope of this invention. However, it is emphasized that in one or more doped or undoped compositions of matter, molybdenum may be intentionally engineered as a dopant into a powder at concentrations of 100 ppm or less, and these are included in the scope of this invention.

In a generic sense, the invention provides nanoscale powders, and in a more generic sense, submicron powders comprising at least 100 ppm by weight, in some embodiments greater than 1 weight % by metal basis, and in other embodiments greater than 10 weight % by metal basis of molybdenum (Mo).

While several embodiments for manufacturing nanoscale and submicron powders comprising molybdenum are disclosed, for the purposes herein, the nanoscale or submicron powders may be produced by any method or may result as a byproduct from any process.

FIG. 1 shows an exemplary overall approach for the production of submicron powders in general and nanopowders in particular. The process shown in FIG. 1 begins with a molybdenum containing raw material (for example, but not limited to, coarse oxide powders, metal powders, salts, slurries, waste products, organic compounds, or inorganic compounds). FIG. 1 shows one embodiment of a system for producing nanoscale and submicron powders in accordance with the present invention.

The process shown in FIG. 1 begins at 100 with a molybdenum metal-containing precursor such as an emulsion, fluid, particle-containing fluid suspension, or water-soluble salt. The precursor may be evaporated molybdenum metal vapor, evaporated alloy vapor, a gas, a single-phase liquid, a multi-phase liquid, a melt, a sol, a solution, a fluid mixture, a solid suspension, or combinations thereof. The metal-containing precursor comprises a stoichiometric or a non-stoichiometric metal composition with at least some part in a fluid phase. Fluid precursors are utilized in certain embodiments of this invention. Typically, fluids are easier to convey, evaporate, and thermally process, and the resulting product is more uniform.

In one embodiment, the precursors are environmentally benign, safe, readily available, high-metal loading, lower-cost fluid materials. Examples of suitable molybdenum metal-containing precursors include, but are not limited to, metal acetates, metal carboxylates, metal ethanoates, metal alkoxides, metal octoates, metal chelates, metallo-organic compounds, metal halides, metal azides, metal nitrates, metal sulfates, metal hydroxides, metal salts soluble in organic solvents or water, ammonium comprising compound of the metal, sodium/potassium/lithium comprising compound of the metal, and metal-containing emulsions.

In another embodiment, multiple metal precursors may be mixed if complex nano-nanoscale and submicron powders are desired. For example, a molybdenum precursor and cobalt (or nickel or iron or vanadium) precursor may be mixed to prepare mixed metal oxide powders comprising molybdenum for catalyst applications. As another example, a molybdenum precursor and silicon precursor may be mixed in correct proportions to yield a high purity, high surface area, mixed silicide (e.g. $MoSi_2$) powder for thermal applications. In yet another example, a potassium precursor (and/or Li, Rb, Cs, Tl precursors) and a molybdenum precursor may be mixed to yield red, blue, purple, or rare earth bronze powders for pigment, electrical and optical applications. One of skill in the art would be able to readily adjust the ratio of the precursor components to obtain the desired properties. Such complex nanoscale and submicron powders can help create materials with surprising and unusual properties not available through the respective single metal oxides or a simple nanocomposite formed by physically blending powders of different compositions.

It is desirable to use precursors of a higher purity to produce a nanoscale or submicron powder of a desired purity. For example, if a purity greater than x % (by metal weight basis) is desired, one or more precursors that are mixed and used may have purities greater than or equal to x % (by metal weight basis) to practice the teachings herein.

With continued reference to FIG. 1, the metal-containing precursor 100 (containing one or a mixture of metal-containing precursors) is fed into a high temperature process 106, which may be implemented using a high temperature reactor, for example. In some embodiments, a synthetic aid such as a reactive fluid 108 may be added along with the precursor 100 as it is being fed into the reactor 106. Examples of such reactive fluids include, but are not limited to, hydrogen, ammonia, halides, carbon oxides, methane, oxygen gas, and air.

While the discussion herein focuses on methods of preparing nanoscale and submicron powders of oxides, the teachings can be readily extended by one of ordinary skill in the art to obtain compositions such as carbides, nitrides, borides, carbonitrides, and chalcogenides. These compositions can be prepared from micron-sized powder precursors of these compositions or by utilizing reactive fluids that provide the elements desired in compositions comprising molybdenum. In some embodiments, high temperature processing may be used. However, a moderate temperature processing or a low/cryogenic temperature processing may also be employed to produce nanoscale and submicron powders using the methods of the present invention.

The precursor 100 may be pre-processed in a number of other ways before any thermal treatment. For example, the pH may be adjusted to ensure precursor stability. Selective solution chemistry, such as precipitation with or without the presence of surfactants or other synthesis aids, may be employed to form a sol or other state of matter. The precursor 100 may be pre-heated or partially combusted before the thermal treatment.

The precursor 100 may be injected axially, radially, tangentially, or at any other angle into the high temperature region 106. As stated above, the precursor 100 may be premixed or diffusionally mixed with other reactants. The precursor 100 may be fed into the thermal processing reactor by a laminar, parabolic, turbulent, pulsating, sheared, or cyclonic flow pattern, or by any other flow pattern. In addition, one or more metal-containing precursors 100 can be injected from one or more ports in the reactor 106. The feed spray system may yield a feed pattern that envelops the heat source or, alternatively, the heat sources may envelop the feed, or alternatively, various combinations of this may be employed. In some embodiments, the spray is atomized and sprayed in a manner that enhances heat transfer efficiency, mass transfer efficiency, momentum transfer efficiency, and reaction efficiency. The reactor shape may be cylindrical, spherical, conical, or any other shape. Methods and equipment such as those taught in U.S. Pat. Nos. 5,788,738, 5,851,507, and 5,984,997 (each of which is specifically incorporated herein by reference) can be employed.

With continued reference to FIG. 1, after the precursor 100 has been fed into reactor 106, it may be processed at high temperatures to form the product powder. In other embodiments, the thermal processing may be performed at lower temperatures to form the powder product. The thermal treatment may be done in a gas environment with the aim to produce products, such as powders, that have the desired porosity, density, morphology, dispersion, surface area, and composition. This step produces by-products such as gases. To reduce costs, these gases may be recycled, mass/heat integrated, or used to prepare the pure gas stream desired by the process.

In embodiments using high temperature thermal processing, the high temperature processing may be conducted at step 106 (FIG. 1) at temperatures greater than 1500 K, in some embodiments greater than 2500 K, in some embodiments greater than 3000 K, and in some embodiments greater than 4000 K. Such temperatures may be achieved by various methods including, but not limited to, plasma processes, combustion in air, combustion in purified oxygen or oxygen rich gases, combustion with oxidants, pyrolysis, electrical arcing in an appropriate reactor, and combinations thereof. The plasma may provide reaction gases or may provide a clean source of heat.

A high temperature thermal process at 106 results in a vapor comprising the metal(s) in one or more phases. After the thermal processing, this vapor is cooled at step 110 to nucleate submicron powders, in certain embodiments nanopowders. In certain embodiments, the cooling temperature at step 110 is maintained high enough to prevent moisture condensation. The particles form because of the thermokinetic conditions in the process. By engineering the process conditions, such as pressure, residence time, supersaturation and nucleation rates, gas velocity, flow rates, species concentrations, diluent addition, degree of mixing, momentum transfer, mass transfer, and heat transfer, the morphology, phase and other characteristics of the nanoscale and submicron powders can be tailored.

In certain embodiments, the nanopowder is quenched after cooling to lower temperatures at step 116 to minimize and prevent agglomeration or grain growth. Suitable quenching methods include, but are not limited to, methods taught in U.S. Pat. No. 5,788,738. In certain embodiments, sonic to supersonic quenching may be used. In other embodiments, coolant gases, water, solvents, cold surfaces, or cryogenic fluids can be employed. In certain embodiments, quenching methods are employed which can prevent deposition of the powders on the conveying walls. These methods include, but are not limited to, electrostatic means, blanketing with gases, the use of higher flow rates, mechanical means, chemical means, electrochemical means, or sonication/vibration of the walls.

In some embodiments, the high temperature processing system includes instrumentation and software that can assist in the quality control of the process. Furthermore, in certain embodiments, the high temperature processing zone 106 is operated to produce fine powders 120, in certain embodiments submicron powders, and in certain embodiments nanopowders. The gaseous products from the process may be monitored for composition, temperature, and other variables to ensure quality at step 112 (FIG. 1). The gaseous products may be recycled to be used in process 106 or used as a valuable raw material when nanoscale and submicron powders 120 have been formed, or they may be treated to remove environmental pollutants, if any. Following quenching step 116, the nanoscale and submicron powders may be cooled further and then harvested at step 118.

The product nanoscale and submicron powders 120 may be collected by any method. Suitable collection means include, but are not limited to, bag filtration, electrostatic separation, membrane filtration, cyclones, impact filtration, centrifugation, hydrocyclones, thermophoresis, magnetic separation, and combinations thereof.

The quenching at step 116 may be modified to enable preparation of coatings. In such embodiments, a substrate may be provided (in batch or continuous mode) in the path of the quenching powder containing gas flow. By engineering the substrate temperature and the powder temperature, a coating comprising the submicron powders and nanoscale powders can be formed.

In some embodiments, a coating, film, or component may also be prepared by dispersing the fine nanopowder and then applying various known methods, such as, but not limited to, electrophoretic deposition, magnetophorectic deposition, spin coating, dip coating, spraying, brushing, screen printing, ink-jet printing, toner printing, and sintering. The nanopowders may be thermally treated or reacted to enhance their electrical, optical, photonic, catalytic, thermal, magnetic, structural, electronic, emission, processing, or forming properties before such a step.

It should be noted that the intermediate or product at any stage of the process described herein, or similar process based on modifications by those skilled in the art, may be used directly as a feed precursor to produce nanoscale or fine powders by methods taught herein and other methods. Other suitable methods include, but are not limited to, those taught in commonly owned U.S. Pat. Nos. 5,788,738, 5,851,507, and 5,984,997, and co-pending U.S. patent application Ser. Nos. 09/638,977 and 60/310,967, which are all incorporated herein by reference in their entirety. For example, a sol may be blended with a fuel and then utilized as the feed precursor mixture for thermal processing above 2500 K to produce simple or complex nanoscale powders.

In summary, one embodiment for manufacturing powders comprises (a) preparing a precursor comprising at least 100 ppm by weight of molybdenum element; (b) feeding the precursor into a high temperature reactor operating at temperatures greater than 1500 K, in certain embodiments greater than 2500 K, in certain embodiments greater than 3000 K, and in certain embodiments greater than 4000 K; (c) wherein, in the high temperature reactor, the precursor converts into vapor comprising the metal in a process stream with a velocity above 0.25 mach in an inert or reactive atmosphere; (d) the vapor is cooled to nucleate submicron or nanoscale powders; (e) the powders are then quenched at high gas velocities to prevent agglomeration and growth; and (f) the quenched powders are filtered from the gases.

Another embodiment for manufacturing nanoscale powders comprising molybdenum comprises (a) preparing a fluid precursor comprising two or more metals, at least one of which is molybdenum in a concentration greater than 100 ppm by weight; (b) feeding the said precursor into a high temperature reactor operating at temperatures greater than 1500 K, in some embodiments greater than 2500 K, in some embodiments greater than 3000 K, and in some embodiments greater than 4000 K in an inert or reactive atmosphere; (c) wherein, in the said high temperature reactor, the said precursor converts into vapor comprising molybdenum; (d) the vapor is cooled to nucleate submicron or nanoscale powders; (e) the powders are then quenched at gas velocities exceeding 0.1 Mach to prevent agglomeration and growth; and (f) the quenched powders are separated from the gases. In certain embodiments, the fluid precursor may include synthesis aids such as surfactants (also known as dispersants, capping agents, emulsifying agents, etc.) to control the morphology or to optimize the process economics and/or product performance.

One embodiment for manufacturing coatings comprises (a) preparing a fluid precursor comprising one or more metals, one of which is molybdenum; (b) feeding the said precursor into a high temperature reactor operating at temperatures greater than 1500 K, in some embodiments greater than 2500 K, in some embodiments greater than 3000 K, and in some embodiments greater than 4000 K in an inert or reactive atmosphere; (c) wherein, in the high temperature reactor, the precursor converts into vapor comprising the molybdenum; (d) the vapor is cooled to nucleate submicron or nanoscale powders; (e) the powders are then quenched onto a substrate to form a coating on the substrate comprising molybdenum.

The powders produced by teachings herein may be modified by post-processing as taught by commonly owned U.S. patent application Ser. No. 10/113,315, which is hereby incorporated by reference in its entirety.

Methods for Incorporating Nanoparticles into Products

The submicron and nanoscale powders taught herein may be incorporated into a composite structure by any method. Some non-limiting exemplary methods are taught in commonly owned U.S. Pat. No. 6,228,904, which is hereby incorporated by reference in its entirety.

The submicron and nanoscale powders may be incorporated into plastics by any method. In one embodiment, the method comprises (a) preparing nanoscale or submicron powders comprising molybdenum by any method, such as a method that employs fluid precursors and a peak processing temperature exceeding 1500 K; (b) providing powders of one or more plastics; (c) mixing the nanoscale or submicron powders with the powders of plastics; and (d) co-extruding the mixed powders into a desired shape at temperatures greater than the softening temperature of the powders of plastics but less than the degradation temperature of the powders of plastics. In another embodiment, a masterbatch of the plastic powder comprising nanoscale or submicron powders comprising molybdenum is prepared. These masterbatches can later be processed into useful products by techniques well known to those skilled in the art. In yet another embodiment, the molybdenum metal containing nanoscale or submicron powders are pretreated to coat the powder surface for ease in dispersability and to ensure homogeneity. In a further embodiment, injection molding of the mixed powders comprising nanoscale powders and plastic powders is employed to prepare useful products.

One embodiment for incorporating nanoscale or submicron powders into plastics comprises (a) preparing nanoscale or submicron powders comprising molybdenum by any method, such as a method that employs fluid precursors and peak processing temperature exceeding 1500 K; (b) providing a film of one or more plastics, wherein the film may be laminated, extruded, blown, cast, or molded; and (c) coating the nanoscale or submicron powders on the film of plastic by techniques such as spin coating, dip coating, spray coating, ion beam coating, and sputtering. In another embodiment, a nanostructured coating is formed directly on the film by techniques such as those taught herein. In some embodiments, the grain size of the coating is less than 200 nm, in some embodiments less than 75 nm, and in some embodiments less than 25 nm.

Submicron and nanoscale powders may be incorporated into glass by any method. In one embodiment, nanoparticles of molybdenum are incorporated into glass by (a) preparing nanoscale or submicron powders comprising molybdenum by any method, such as a method that employs fluid precursors and temperature exceeding 1500 K in an inert or reactive atmosphere; (b) providing glass powder or melt; (c) mixing the nanoscale or submicron powders with the glass powder or melt; and (d) processing the glass comprising nanoparticles into articles of desired shape and size.

Submicron and nanoscale powders may be incorporated into paper by any method. In one embodiment, the method comprises (a) preparing nanoscale or submicron powders comprising molybdenum; (b) providing paper pulp; (c) mixing the nanoscale or submicron powders with the paper pulp; and (d) processing the mixed powders into paper by steps such as molding, couching and calendering. In another embodiment, the molybdenum metal containing nanoscale or submicron powders are pretreated to coat the powder surface for ease in dispersability and to ensure homogeneity. In a further embodiment, nanoparticles are applied directly on the manufactured paper or paper-based product; the small size of nanoparticles enables them to permeate through the paper fabric or reside on the surface of the paper and thereby functionalize the paper.

Submicron and nanoscale powders may be incorporated into leather, fibers, or fabric by any method. In one embodiment, the method comprises (a) preparing nanoscale or submicron powders comprising molybdenum by any method, such as a process that includes a step that operates above 1000 K; (b) providing leather, fibers, or fabric; (c) bonding the nanoscale or submicron powders with the leather, fibers, or fabric; and (d) processing the bonded leather, fibers, or fabric into a product. In yet another embodiment, the molybdenum metal containing nanoscale or submicron powders are pretreated to coat or functionalize the powder surface for ease in bonding or dispersability or to ensure homogeneity. In a further embodiment, nanoparticles are applied directly on a manufactured product based on leather, fibers, or fabric; the small size of nanoparticles enables them to adhere to or permeate through the leather, fibers (polymer, wool, cotton, flax, animal-derived, agri-derived), or fabric and thereby functionalize the leather, fibers, or fabric.

The submicron and nanoscale powders taught herein may be incorporated into creams or inks by any method. In one embodiment, the method comprises (a) preparing nanoscale or submicron powders comprising molybdenum by any method, such as a method that employs fluid precursors and peak processing temperature exceeding 1500 K; (b) providing a formulation of cream or ink; and (c) mixing the nanoscale or submicron powders with the cream or ink. In yet another embodiment, the molybdenum comprising nanoscale or submicron powders are pretreated to coat or functionalize the powder surface for ease in dispersability and to ensure homogeneity. In a further embodiment, pre-existing formulation of a cream or ink is mixed with nanoscale or submicron powders to functionalize the cream or ink.

Nanoparticles comprising molybdenum can be difficult to disperse in water, solvents, plastics, rubber, glass, paper, etc. The dispersability of the nanoparticles can be enhanced in certain embodiments by treating the surface of the molybdenum oxide powders or other molybdenum comprising nanoparticles. For example, fatty acids (e.g. propionic acid, stearic acid and oils) or substances with low or high hydrophilicity and/or lipophilicity characteristics can be applied to or with the nanoparticles to enhance the surface compatibility. If the powder has an acidic surface, ammonia, quaternary salts, or ammonium salts can be applied to the surface to achieve a desired surface pH. In other cases, acetic acid wash can be used to achieve the desired surface state. Trialkyl phosphates and phosphoric acid can be applied to reduce dusting and chemical activity. In yet other cases, the powder may be thermally treated to improve the dispersability of the powder.

Applications of Nanoparticles and Submicron Powders Comprising Molybdenum

Pigments

Nanoparticles comprising molybdenum containing multimetal oxides offer some surprising and unusual benefits as pigments. Nanoparticles are smaller than the visible wavelengths of light, which leads to visible wavelengths interacting in unusual ways with nanoparticles compared to particles with grain sizes much bigger than the visible wavelengths (400-700 nm). The small size of nanoparticles can also lead to more uniform dispersion. In certain embodiments, it is important that the nanoparticles be non-agglomerated (i.e. do not have sintered neck formation or hard agglomeration). In some embodiments, the nanoparticles have non-functionalized, i.e., clean, surfaces. In other embodiments, the surface is modified or functionalized to enable bonding with the matrix in which they need to be dispersed.

One of the outstanding process challenges for manufacturing inorganic pigments is the ability to ensure homogeneous lattice level mixing of elements in a complex multi-metal formulation. One of the features of the process described herein is its ability to prepare complex compositions with the necessary homogeneity. Therefore, the teachings herein are ideally suited for creating color and making superior performing pigments with nanoparticles comprising molybdenum.

Some non-limiting illustrations of pigments containing molybdenum are molybdenum chrome, lead molybdenum oxide, phosphomolybdates, phosphotungstate-phosphomolybdates (PTMA), molybdenum blues, and non-stoichiometric substances comprising molybdenum.

In one embodiment, a method for manufacturing a pigmented product comprises (a) preparing nanoscale or submicron powders comprising molybdenum; (b) providing powders of one or more plastics; (c) mixing the nanoscale or submicron powders with the powders of plastics; and (d) processing the mixed powders into the product. In yet another embodiment, the molybdenum containing nanoscale or submicron powders are pretreated to coat the powder surface for ease in dispersability and to ensure homogeneity. In a further embodiment, extrusion or injection molding of the mixed powders comprising nanoscale powders and plastic powders can be employed to prepare useful products.

Additives

Nanoscale molybdenum comprising substances are useful lubricating additives (i.e., reduce static or dynamic coefficient of friction (COF) between two surfaces by 5% or more; COF can be measured by standards such as ASTM D3702, ASTM D1894, which are hereby incorporated by reference in their entirety). A non-limiting illustration is molybdenum disulfide nanoparticles. The small size of molybdenum disulfide nanoparticles enables thinner films in certain embodiments offering reduced costs at higher performance. Such lubricating nanoparticles, in some embodiments, possess the ability to distribute forces more uniformly or lubricate surfaces even at high operating temperatures. In certain embodiments such as high precision, tight gap moving surfaces, lubricating additives may be added to the lubricating fluid, oils, plastic, rubber, coatings, ceramics, or powder metal matrices. One unusual characteristic that makes lubricating nanoparticle additives useful is that the particle size enabled by nanotechnology can be less than the naturally occurring characteristic roughness sizes. The nanoparticles can enter and buffer (and/or reside in) crevices and troughs, thereby reducing the damaging internal pressures, forces and inefficient thermal effects. Existing molybdenum disulfide powders are usually in 1 to 40 micron or higher range, constraining their performance and their use. For high temperature applications, molybdenum disulfide nanoparticles are useful to 1200 K in certain embodiments such as those involving vacuum or inert atmospheres and to 1600 K in other embodiments. In other embodiments such as those involving atmospheres that comprise oxidizing or reactive species they are useful to 700 K. These additives can be dispersed in existing or novel lubricating formulations and thereby provide an easy way to incorporate the benefits of nanotechnology. These additives are also useful to prevent fretting, galling, and seizing, and (as additives for antiwear applications, mold release surfaces, and in coatings related to metal forming operations). Molybdenum disulfide, tungsten molybdenum sulfide and such inorganic or organic nanoparticle compositions are useful lubricating additives elsewhere as well, e.g., on shaving blades and any surface that requires minimization of the adverse effects of friction. In addition to molybdenum disulfide, nanoparticles comprising oil soluble molybdenum sulfur compounds can also be utilized for these applications.

Corrosion Inhibition

Sodium molybdenum oxide nanoparticles, in certain embodiments in high purity form, are useful in corrosion inhibition applications. The high surface area of molybdenum comprising nanoparticles, particularly when the mean particle size is less than 100 nanometers, makes them useful in these applications. They are excellent replacement for the more toxic hexavalent chromium compounds, given the very low toxicity of molybdenum in contrast with hexavalent chrome. In other embodiments, potassium molybdates, lithium molybdates, zinc molybdates, strontium molybdates, calcium molybdates, or other molybdenum comprising nanoparticles are useful as corrosion inhibiting compounds. Molybdate comprising nanoparticles are useful corrosion inhibitors for ferrous and non-ferrous metals over a wide pH range. The performance of molybdates, which are anodic inhibitors, in corrosion protection applications can be further improved by using them in combination with cathodically active compounds (e.g., zinc compounds, in certain embodiments nanoparticles comprising zinc or the like). They may be used with zinc phosphates comprising nanoparticles in some embodiments to prepare thin corrosion resistant coatings (in some embodiments these coatings are less than 10 micron in thickness). In other embodiments, core-shell coated nanoparticles of the type taught in co-owned U.S. Pat. No. 6,228,904 are useful when the core is anodic inhibitor and the shell is cathodic inhibitor, or vice versa. A specific, but non-limiting example, of core-shell nanoparticle is calcium molybdate coated on zinc oxide nanoparticles. Illustrative products that can benefit from corrosion inhibition nanotechnology using molybdenum comprising nanoparticles include hydraulic fluids, boiler waters, metal working fluids, hot forging, aluminum anodizers, oil well drilling equipment, brake linings, coal-water slurry equipment, brine processing or handling equipment, paint spray equipment, pitting prevention in steels, paper processing industry, and any other where corrosion is an issue. As mentioned already, anywhere hexavalent chrome is useful for corrosion prevention, molybdenum comprising nanoparticles can be used as a substitute without the toxicity of the hexavalent chrome.

Flame Retardancy and Smoke Suppression

Sodium molybdenum oxide nanoparticles and other molybdenum comprising nanomaterials are useful as flame retardants and smoke suppressants. The high surface area and small particle size of molybdenum comprising nanoparticles, particularly when the mean particle size is less than 100 nanometers, make them surprisingly useful in these applications. Their size enables them to permeate through and/or reside in the pores/internal surfaces and to external surface topography in natural and synthetic fibers, wood, paper, polymers, cotton, leather, resins, composites, films, consumer goods, industrial goods, computer housing materials, gaskets, o-rings, packaging materials, electromagnetic conductor covering materials, devices, and the like. With conventional smoke suppressants and flame retardants, weathering and laundering causes wash off and removal of the additives, which makes the product less resistant to flame and more smoke prone. Molybdenum comprising nanoparticles and related nanotechnology products extend product life and promote smoke suppression and resistance to flame. This insight can be extended to other compositions (with or without Mo) that promote flame retardancy and smoke suppression. Some specific, non-limiting embodiments of molybdenum comprising nanomaterials for flame retardancy and smoke suppression include molybdenum disulfide, molybdenum oxide, sodium molybdenum oxide, calcium molybdenum oxide, zinc molybdenum oxide, copper molybdenum oxide, iron molybdenum oxide (Fe in III state in certain embodiments), nickel molybdenum oxide, ammonium molybdenum oxide and mixtures of these. In other embodiments, core-shell coated nanoparticles of the type taught in co-owned U.S. Pat. No. 6,228,904, which is hereby incorporated by reference in its entirety, are useful as flame retardants and smoke suppressants when the core is polymer and the shell is flame retardant. Illustrative products that can benefit from the flame-retarding and smoke-suppressing properties of molybdenum comprising nanoparticles include buildings, transportation means, wires, health care products, computers, office devices, home and industrial appliances, and cable products.

Agriculture Applications

Sodium molybdenum oxide nanoparticles and other molybdenum comprising nanomaterials are useful as a source of molybdenumn an essential trace element nutrient. The high surface area and small particle size of molybdenum comprising nanoparticles, particularly when the mean particle size is less than 100 nanometers, make them surprisingly useful in these applications. Their size enables them to permeate through and/or reside in the pores/internal surfaces and to external surface topography of seeds or soil.

Catalysts

Molybdenum containing nanoparticles such as oxides, sulfides and heteropoly complexes are useful catalysts for a number of chemical reactions. For example, they can be used as a catalyst or a promoter in reactions with molecular hydrogen, hydrogenation, hydrogenolysis, reduction, desulfurization of feedstocks, selective oxidation and reactions with molecular oxygen, decomposition reactions, isomerization, addition reaction, coal liquefaction, etherification, and oxidation with other oxidants such as epoxidation reactions. In one embodiment, a method for producing more desirable or valuable substances from other substances, such as less valuable substances, comprises (a) preparing doped or undoped nanoscale powders comprising molybdenum such that the surface area of the said powder is greater than 25 square meter per gram, in some embodiments greater than 75 square meter per gram, and in some embodiments greater than 150 square meter per gram; and (b) activating the powder in an environment at temperatures between 300K and 1500K (e.g. reducing the powder in a reducing fluid at 800K) and then conducting a chemical reaction over the said nanoscale powders comprising doped or undoped molybdenum compound. In some embodiments, a further step of dispersing the nanoscale powders in a solvent and then depositing these powders onto a catalyst support or substrate from the dispersion may be employed before chemical reactions are conducted. Illustrations of support include alumina, silica, chlorides, carbon and the like.

Stoichiometric or non-stoichiometric molybdenum containing nanoparticles such as oxides, sulfides and heteropoly complexes are, in certain embodiments, doped with other elements and/or combined with other compositions to achieve desirable catalytic properties. Illustrations of such compositions include cobalt chloride, copper oxide, cobalt oxide, vanadium oxide, tellurium oxide, selenium oxide, bismuth oxide, phosphorus oxide, magnesium oxide, tin oxide and the like. Illustrations of doped molybdenum compositions useful for catalytic applications include molybdenum cobalt oxychloride, molybdenum copper oxide, molybdenum cobalt oxide, molybdenum vanadium oxide, molybdenum tungsten oxide, molybdenum tellurium oxide, molybdenum cobalt tellurium oxide, molybdenum selenium oxide, molybdenum vanadium tin copper oxide, molybdenum bismuth oxide, molybdenum phosphorus oxide, molybdenum magnesium oxide, molybdenum tin oxide, molybdenum copper sulfide, molybdenum cobalt sulfide, molybdenum vanadium sulfide, molybdenum tungsten sulfide, molybdenum vanadium tin copper sulfide, and the like.

The catalyst powders described above can be combined with zeolites and other well defined porous materials to enhance the selectivity and yields of useful chemical reactions. In certain embodiments, the catalyst powders are surface treated to modify their performance.

Reagent and Raw Material for Synthesis

Nanoparticles comprising molybdenumm such as molybdenum oxide and molybdenum containing multi-metal oxide nanoparticles, are useful reagents and precursors for preparing other compositions containing nanoparticles comprising molybdenum. In a generic sense, nanoparticles comprising molybdenum are reacted with another substance such as, but not limited to, an acid, alkali, organic molecules, monomers, oligomers, enzymes, nitrogen-containing compound such as, e.g., ammonia, hydrogen-containing species such as, e.g., hydrogen, oxygen-containing species such as, e.g., oxygen, reducing fluids, oxidizing fluids, halogens, phosphorus compounds, chalcogenides, biological materials, gas, vapor, or solvents. In one embodiment, the molybdenum-comprising nanoparticles have an aspect ratio greater than one. The high surface area of nanoparticles facilitates the reaction and the product resulting from this reaction is also nanoparticles. These product nanoparticles can then be suitably applied or utilized to catalyze other reactions or as reagents to prepare other fine chemicals for a wide range of applications.

A few non-limiting illustrations of the uses of molybdenum comprising nanoparticles follow. These teachings can be extended to multi-metal oxides and to other compositions such as molybdenum interstitial compounds and organometallics based on molybdenum. In certain embodiments, the nanoparticles may be treated or functionalized or activated under various temperatures, pressures, charges, or environmental conditions before use.

Molybdenum: Molybdenum oxide nanoparticles are reacted with carbon or reacted with hydrogen comprising reducing gases at temperatures above 600° C., in certain embodiments above 1500° C., to produce nanoparticles of Mo metal. In certain embodiments, lower temperatures may be used. In other embodiments, heating the nanocrystals in a vacuum or at ambient pressure or higher pressures at temperatures such as 800 K, 1200 K, etc. may be used. In other embodiments, molybdenum oxide nanoparticles are reacted with coarse or nanoscale silicon (or aluminum) powders to produce nanoparticles of Mo metal. If ferrosilicon powders are used, one gets ferromolybdenum nanoparticles. Molybdenum metal nanoparticles are useful in many applications (such as forming molybdenum metal wire for filaments, etc.) and as a precursor for forming other molybdenum comprising compositions of matter.

An embodiment for producing nanoparticles comprising molybdenum comprises (a) preparing nanoscale powders comprising molybdenum oxide; (b) reacting the nanoscale powders with a reducing composition or under a reducing environment; and (c) collecting resultant nanoparticles comprising molybdenum. The higher surface area of molybdenum comprising nanomaterials enables surprisingly lower temperatures and shorter times for the conversion to nanoparticles of Mo metal.

Molybdenum Halides: Molybdenum comprising nanoparticles are reacted with a halogen comprising compound to form molybdenum halide comprising compounds. In an illustrative, non-limiting example, molybdenum nanoparticles are chlorinated to prepare $MoCl_5$ (a dark green black dimerized solid) nanoparticles. The chlorination is performed above 20° C. and 100-1000 Torr in one embodiment (other combinations of T and P may be used in other embodiments). Molybdenum fluoride is prepared in one embodiment by reacting fluorine with molybdenum nanoparticles.

Molybdenum suboxides: Molybdenum oxide ($MOO_3$) nanoparticles are reacted with reducing compounds such as hydrogen to produce nanoparticles of molybdenum suboxides (e.g. $MoO_{0.23-2.999}$). The suboxides possess different colors depending on the non-stoichiometry (e.g. red, blue, purple, brown).

Molybdenum bronzes: Molybdenum bronze nanoparticles can be represented by the generic formula $A_{1-x}MoO_3$. The A in this generic formula can be an alkali metal (Li, Na, K, Cs, Rb) or any other metal. The x in the generic formula can be zero or any number higher than zero and less than one. Molybdenum bronze nanoparticles can be prepared by reacting molybdenum oxide nanoparticles with any compound of A. In some embodiments, this is an oxide of metal A, or a hydroxide of A, or metal A. In other embodiments, other compositions can be employed. The reaction may be facilitated if conducted at higher temperatures, under vacuum or at high pressures, or under a gaseous environment containing, e.g., hydrogen, a carbon comprising gaseous species, oxygen, or an inert gas. Other methods for preparing molybdenum bronze nanoparticles include electrolytic reduction, fusion, solid state reactions, co-condensation, vapor phase deposition, sputtering and the like. In some embodiments, nanoparticles of various constituents are used to enable cost effective manufacturing molybdenum bronze nanoparticles with uniform properties. Molybdenum bronze nanoparticles are useful as catalysts and as electrical and optical devices.

Molybdenum chalcogenide compounds: Molybdenum metal nanoparticles or molybdenum oxide nanoparticles are reacted with chalcogenide comprising substances to produce molybdenum chalcogenide comprising nanoparticles. For example, molybdenum metal nanoparticles are reacted above 1000 K with sulfur to produce hexagonal form of $MoS_2$. In another embodiment, molybdenum oxide is reacted with sulfur or hydrogen sulfide in the presence of a promoter (e.g., potassium carbonate) to produce molybdenum disulfide nanoparticles. High temperatures and/or high pressures enable the synthesis of rhombohedral form of nanoparticles.

Molybdate compounds: Molybdates discussed above show unusual nanocluster forming characteristics when certain formulation conditions such as pH are varied. Ammonium molybdates are made by dissolving molybdenum oxide nanoparticles in aqueous ammonia.

Example 1

Molybdenum Comprising Nanopowders

Molybdenum silicide powders were suspended in a mixture of 5 mol % oxygen and argon (200 SLPM). The resulting suspension was sprayed into a DC thermal plasma reactor described herein at a rate of about 1 kg per hour. The peak temperature in the thermal plasma reactor was above 3000 K. The vapor was cooled to nucleate nanoparticles and then quenched by Joule-Thompson expansion. The powders collected were analyzed using X-ray diffraction (Warren-Averbach analysis) and BET. It was discovered that the powders comprised of molybdenum had a crystallite size of less than 100 nm and a specific surface area greater than 10 $m^2$/gm.

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims.

What is claimed is:

1. A nanomaterial composition comprising:

molybdenum disulfide nanoparticles having a mean size less than 250 nanometers; and molybdate nanoparticles having a mean size less than 100 nanometers, wherein the composition of matter reduces the static or dynamic coefficient of friction for a surface by 5% or more.

2. A lubricating fluid comprising the nanomaterial composition of claim 1.

3. A product comprising the nanomaterial composition of claim 1, the product selected from the group consisting of plastics, glasses, leathers, fibers, fabrics, papers, creams, inks, rubbers, pigments, resins, composites, films, polymers, woods, gaskets, O-rings, packaging materials, wires, catalysts, corrosion inhibitors, hydraulic fluids, boiler waters, and metal working fluids.

4. The nanomaterial composition of claim 1, wherein the molybdate nanoparticles are selected from the group consisting of:

(a) sodium molybdenum oxide nanoparticles, (b) potassium molybdate nanoparticles, (c) lithium molybdate nanoparticles, (d) zinc molybdate nanoparticles, (e) strontium molybdate nanoparticles, and (f) calcium molybdate nanoparticles.

5. The nanomaterial composition of claim 1, wherein the molybdate nanoparticles are sodium molybdenum oxide nanoparticles.

6. The nanomaterial composition of claim 1, wherein the molybdate nanoparticles are core-shell coated nanoparticles comprising calcium molybdate coated on zinc oxide nanoparticles.

7. The nanomaterial composition of claim 1, further comprising nanoparticles comprising zinc.

8. The nanomaterial composition of claim 1, further comprising zinc oxide nanoparticles.

9. A coating comprising the nanomaterial composition of claim 1.

10. A nanomaterial composition comprising:

nanoparticles having a mean particle size less than 100 nanometers, wherein the nanoparticles are selected from the group consisting of:

(a) sodium molybdenum oxide nanoparticles, (b) potassium molybdate nanoparticles, (c) lithium molybdate nanoparticles, (d) zinc molybdate nanoparticles, (e) strontium molybdate nanoparticles, and (f) calcium molybdate nanoparticles.

11. The nanomaterial composition of claim 10, further comprising molybdenum disulfide nanoparticles having a mean size less than 250 nanometers.

12. The nanomaterial composition of claim 10, further comprising a cathodically active compound comprising zinc.

13. The nanomaterial composition of claim 10, further comprising nanoparticles comprising zinc.

14. The nanomaterial composition of claim 10, further comprising zinc oxide nanoparticles.

15. The nanomaterial composition of claim 10, wherein the nanoparticles are sodium molybdenum oxide nanoparticles.

16. The nanomaterial composition of claim 10, wherein the nanoparticles are calcium molybdate nanoparticles comprising calcium molybdate coated on zinc oxide nanoparticles.

17. A product comprising the nanomaterial composition of claim 10, the product selected from the group consisting of plastics, glasses, leathers, fibers, fabrics, papers, creams, inks, rubbers, pigments, resins, composites, films, polymers, woods, gaskets, O-rings, packaging materials, wires, catalysts, corrosion inhibitors, hydraulic fluids, boiler waters, and metal working fluids.

18. A coating comprising the nanomaterial composition of claim 10.

19. A nanomaterial composition comprising sodium molybdenum oxide nanoparticles having a mean particle size less than 100 nanometers.

20. A coating comprising the nanomaterial composition of claim 19.

* * * * *